US010478714B1

(12) United States Patent
Yother

(10) Patent No.: US 10,478,714 B1
(45) Date of Patent: Nov. 19, 2019

(54) RING-TOSSING GAME ASSEMBLY

(71) Applicant: Paul David Yother, Mesa, AZ (US)

(72) Inventor: Paul David Yother, Mesa, AZ (US)

( * ) Notice: Subject to any disclaimer, the term of this patent is extended or adjusted under 35 U.S.C. 154(b) by 0 days.

(21) Appl. No.: 16/000,334

(22) Filed: Jun. 5, 2018

(51) Int. Cl.
*A63F 9/02* (2006.01)
*A63B 67/06* (2006.01)

(52) U.S. Cl.
CPC ..... *A63F 9/0208* (2013.01); *A63B 67/06* (2013.01); *A63B 2067/063* (2013.01); *A63F 2009/0213* (2013.01)

(58) Field of Classification Search
CPC ..... A63B 67/06; A63B 67/00; F41J 1/10
See application file for complete search history.

(56) References Cited

U.S. PATENT DOCUMENTS 2,365,513 A * 12/1944 Bartle ..... A63B 67/06 273/339
5,377,849 A * 1/1995 Martin ..... A47F 8/02 211/85.7
5,954,337 A * 9/1999 Cunningham ..... A63B 67/06 273/338
D568,207 S * 5/2008 Oakley ..... D11/181
D581,833 S * 12/2008 Oakley ..... D11/181
2005/0075199 A1* 4/2005 Babiak ..... A63B 67/002 473/468
2006/0097454 A1* 5/2006 Mattson ..... A63B 67/06 273/336
2010/0194048 A1* 8/2010 Medina ..... F41J 1/10 273/407

* cited by examiner

*Primary Examiner* — Eugene L Kim
*Assistant Examiner* — Christopher Glenn

(57) ABSTRACT

A ring-tossing game assembly for entertainment includes a post that is coupled to a base, from which the post extends perpendicularly. Each of a plurality of crossbars is coupled to and extends bidirectionally from the post. Each crossbar is substantially U-shaped so that opposing ends of the crossbar extend toward a top of the post. Each of a plurality of rings is configured to be grasped in a hand of a user who is positioned proximate to the post. The user is positioned to toss the ring toward the post intending the ring to insertably couple to a respective crossbar.

16 Claims, 4 Drawing Sheets

RING-TOSSING GAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

Field of the Invention

Description of Related Art Including Information Disclosed Under 37 CFR 1.97 and 1.98

The disclosure and prior art relates to game assemblies and more particularly pertains to a new game assembly for entertainment.

BRIEF SUMMARY OF THE INVENTION

An embodiment of the disclosure meets the needs presented above by generally comprising a post that is coupled to a base, from which the post extends perpendicularly. Each of a plurality of crossbars is coupled to and extends bidirectionally from the post. Each crossbar is substantially U-shaped so that opposing ends of the crossbar extend toward a top of the post. Each of a plurality of rings is configured to be grasped in a hand of a user who is positioned proximate to the post. The user is positioned to toss the ring toward the post intending the ring to insertably couple to a respective crossbar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
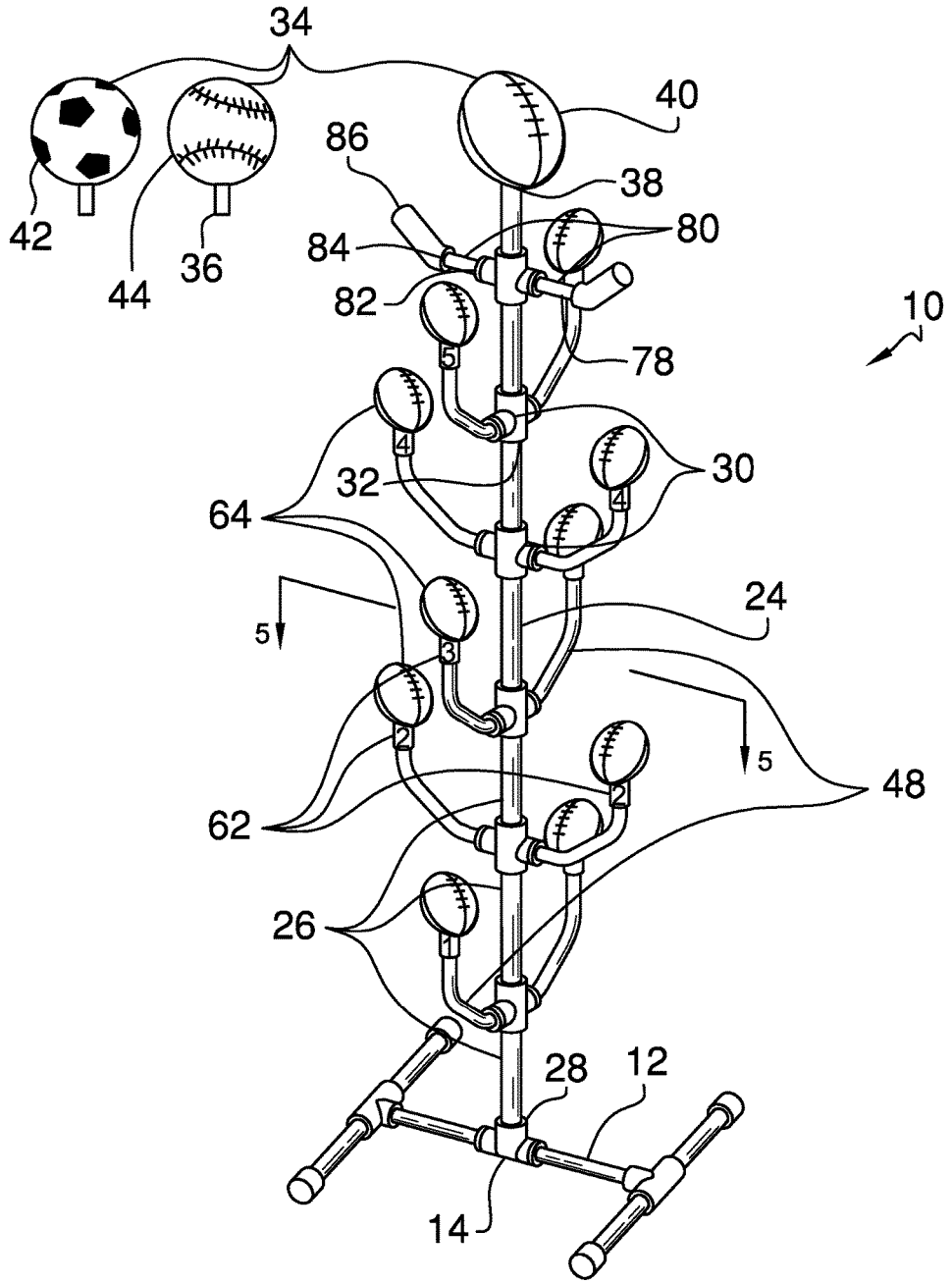
FIG. 1 is an isometric perspective view of a ring-tossing game assembly according to an embodiment of the disclosure.

With reference now to the drawings, and in particular to FIGS. 1 through 6 thereof, a new game assembly embodying the principles and concepts of an embodiment of the disclosure and generally designated by the reference numeral 10 will be described.

As best illustrated in FIGS. 1 through 6, the ring-tossing game assembly 10 generally comprises a base 12. The base 12 comprises a first connector 14 that is T-shaped and tubular-type. Each of a pair of first rods 16 selectively insertable into the first connector 14 so that the first rods 16 are opposingly positioned and frictionally coupled to the first connector 14. Each of a pair of second rods 18 is coupled to and extends bidirectionally from a respective first rod 16 so that the base 12 is substantially I-shaped.

Each second rod 18 comprises a pair of sections 20. Each of a pair of second connectors 22 is coupled to a respective first rod 16 distal from the first connector 14. The second connectors 22 are T-shaped and tubular-type. Each second connector 22 is positioned to selectively insert a respective pair of sections 20 so that the sections 20 are opposingly positioned and frictionally coupled to the second connector 22.

A post 24 is coupled to and extends perpendicularly from the base 12. The post 24 comprises a plurality of tubes 26. The plurality of tubes 26 comprises seven tubes 26. Each tube 26 has a lower end 28. The lower end 28 of a respective tube 26 is positioned to insert into the first connector 14 to couple the post 24 to the base 12. The respective tube 26 is selectively rotatable relative to the base 12.

Figure 2:
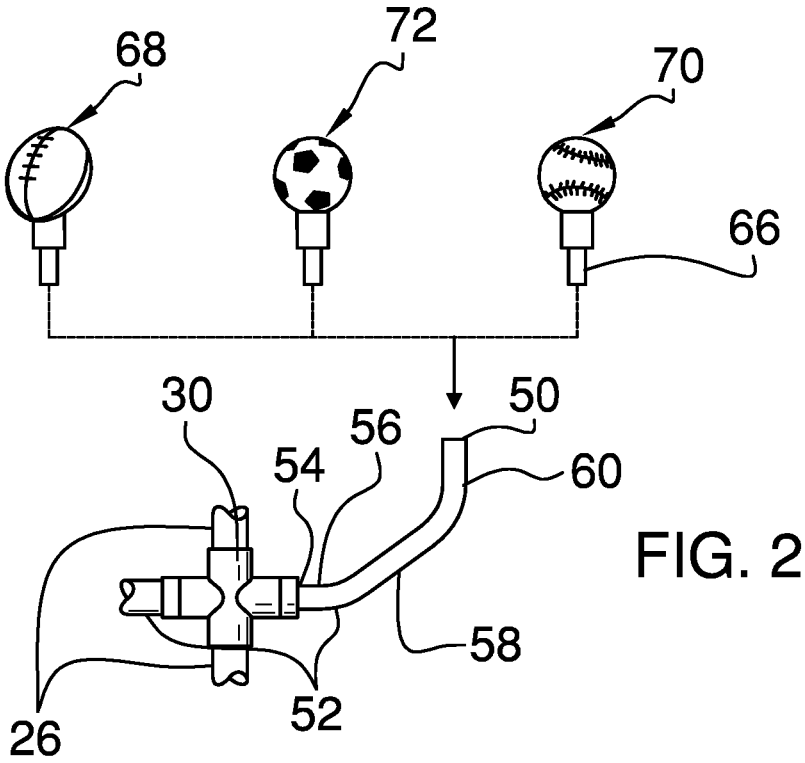
FIG. 2 is a detail view of an embodiment of the disclosure.

Each of a plurality of couplers 30 is coupled to an upper end 32 of a respective tube 26. The couplers 30 are tubular-type and cross-shaped, as shown in FIG. 2. The plurality of tubes 26 is positioned to be interconnected by insertion of the lower end 28 of a respective tube 26 into a respective coupler 30 that is positioned on an adjacently positioned tube 26 to frictionally couple the respective tube 26 to the respective coupler 30. The respective tube 26 is opposingly positioned and selectively rotatable relative to the adjacently positioned tube 26.

The assembly 10 comprises a plurality of finials 34. Each finial 34 comprises a bar 36 that is selectively insertable into a top 38 of the post 24 to couple the finial 34 to the post 24. Each finial 34 has a respective shape so that the plurality of finials 34 comprises finials 34 that have a variety of shapes.

Figure 6:
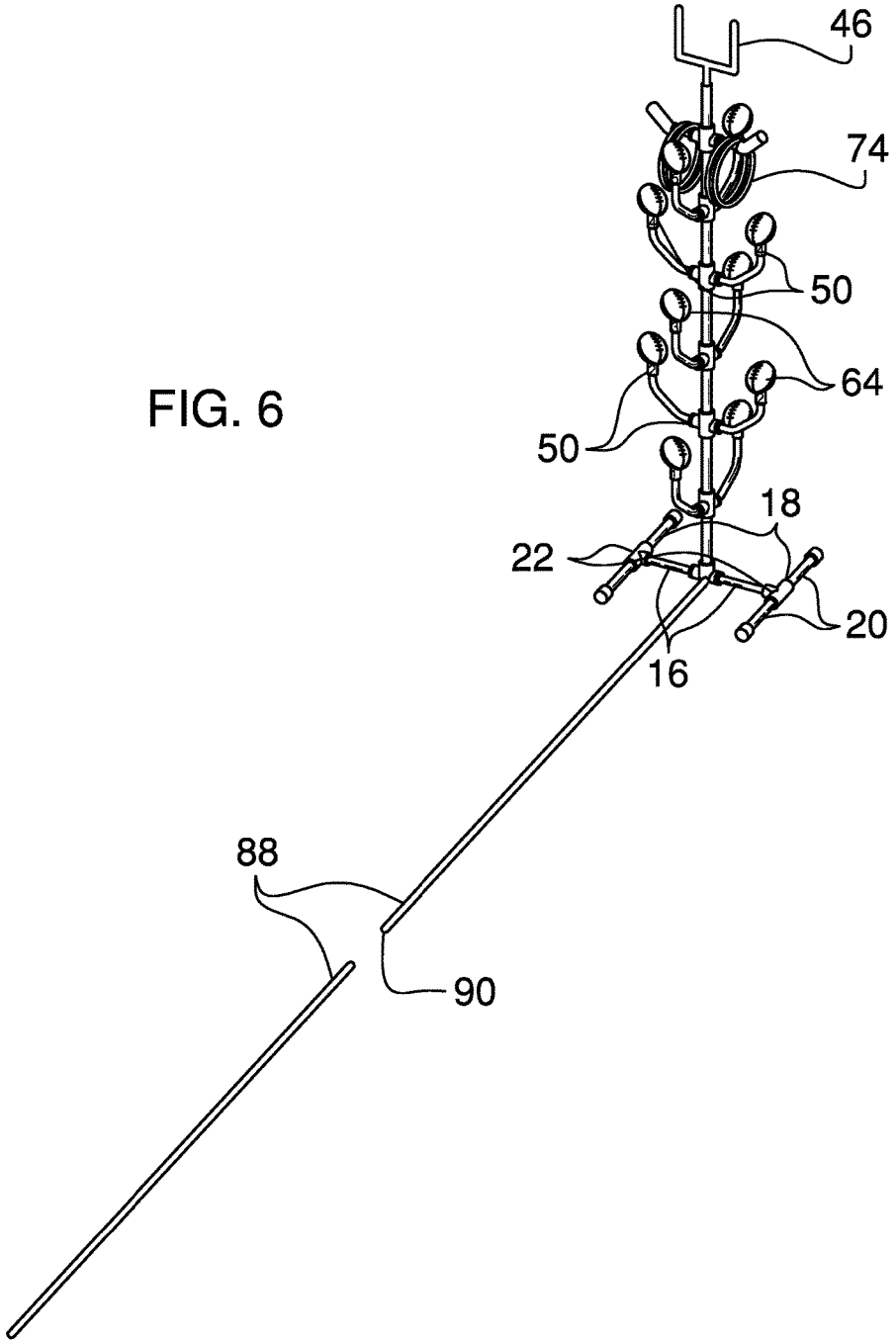
FIG. 6 is an isometric perspective view of an embodiment of the disclosure.

The plurality of finials 34 comprises a football shaped finial 40, as shown in FIG. 1, a baseball shaped finial 42, a soccer ball shaped finial 44, and a goal-post shaped finial 46, as shown in FIG. 6.

Each of a plurality of crossbars 48 is coupled to and extends bidirectionally from the post 24, as shown in FIG. 1. The plurality of crossbars 48 comprises five crossbars 48. Each crossbar 48 is substantially U-shaped so that opposing ends 50 of the crossbar 48 extend toward the top 38 of the post 24. The plurality of crossbars 48 is substantially evenly spaced between the base 12 and the top 38 of the post 24.

Figure 5:
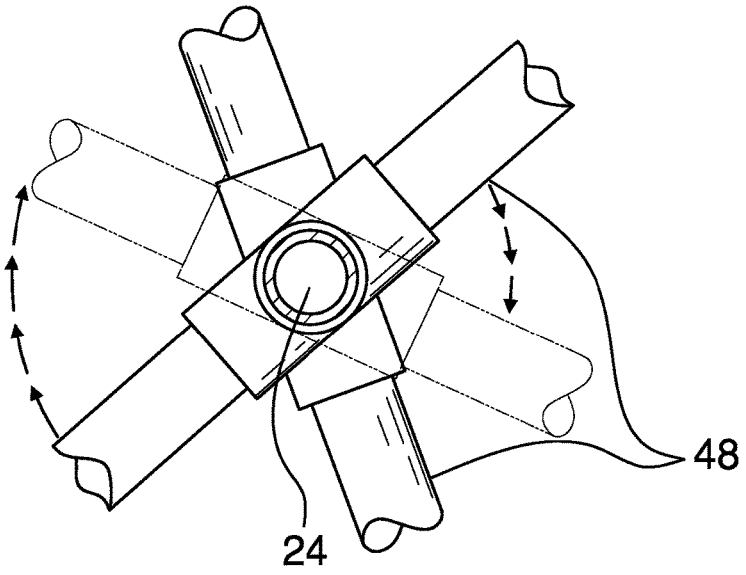
FIG. 5 is a cross-sectional view of an embodiment of the disclosure.

Each crossbar 48 comprises a pair of segments 52, as shown in FIG. 5. The segments 52 are tubular. A terminus 54 of each segment 52 is positioned to be inserted into a respective coupler 30 so that the segments 52 are opposingly positioned and frictionally coupled to the respective coupler 30. The tubes 26 are only frictionally coupled to the couplers 30 so the crossbars 48 are positioned to be selectively rotated, as shown in FIG. 5, to position the crossbars 48 is a variety of configurations. The base 12, the post 24, and the crossbars 48 are configured to be disassembled when not in use.

Each segment 52 has a proximate section 56, a medial section 58, and a distal section 60, as shown in FIG. 2. The proximate section 56 extends perpendicularly from the post 24. The medial section 58 extends transversely from the proximate section 56 distal from the post 24. The distal section 60 extends transversely from the medial section 58 distal from the proximate section 56. The distal section 60 extends perpendicularly to the proximate section 56 and parallelly to the post 24 toward the top 38 of the post 24.

The assembly 10 comprises a plurality of fasteners 62 and a plurality of caps 64, as shown in FIG. 2. The fasteners 62 are coupled singly to each opposing end 50 of the plurality of crossbars 48. The fasteners 62 are tubular-type. Each cap 64 comprises a shaft 66 that is selectively insertable to a respective fastener 62 to frictionally couple the cap 64 to a respective crossbar 48. Each cap 64 has a respective shape so that the plurality of caps 64 comprises caps 64 that have a variety of shapes. The plurality of caps 64 comprises a set of football shaped caps 68, a set of baseball shaped caps 70, and a set of soccer ball shaped caps 72.

Figure 3:
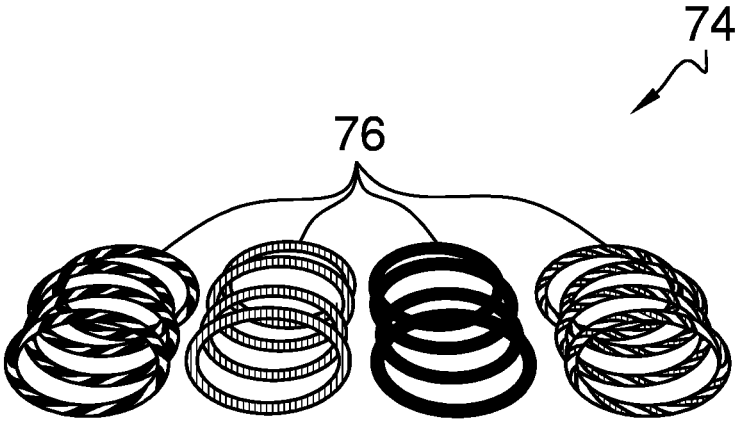
FIG. 3 is an isometric perspective view of an embodiment of the disclosure.

The assembly 10 comprises a plurality of rings 74, as shown in FIG. 3. The plurality of rings 74 comprises four sets of loops 76. Each set of loops 76 has a respective color. Each ring 74 is configured to be grasped in a hand of a user who is positioned proximate to the post 24. The user is positioned to toss the ring 74 toward the post 24 intending the ring 74 to insertably couple to a respective crossbar 48. With the caps 64 positioned on the opposing ends 50 for the crossbars 48, the opposing ends 50 are effectively enlarged and increase the difficulty of tossing a ring 74 onto the respective crossbar 48.

A set of rules would be in place for scoring points in a game based on successfully tossing one or more of the rings 74 onto the crossbars 48. Variations include a different level of points scored for tossing a ring 74 onto a selected crossbar 48, tossing rings 74 onto a respective crossbar 48 in succession, and tossing rings 74 onto selected crossbars 48 in succession.

A crossbeam 78 is coupled to and extends bidirectionally from the post 24 proximate to the top 38, as shown in FIG. 1. The plurality of rings 74 is positioned to be insertably coupled to the crossbeam 78 to store the plurality of rings 74. The crossbeam 78 comprises a pair of pieces 80 that are tubular. A first endpoint 82 of each piece 80 is positioned to be inserted into a respective coupler 30 so that the pieces 80 are opposingly positioned and frictionally coupled to the respective coupler 30. Each piece 80 is bent proximate to a midpoint 84 of the piece 80 so that a second endpoint 86 of the piece 80 extends toward the top 38 of the post 24 and the rings 74 are prevented from sliding off the crossbeam 78.

Figure 4:
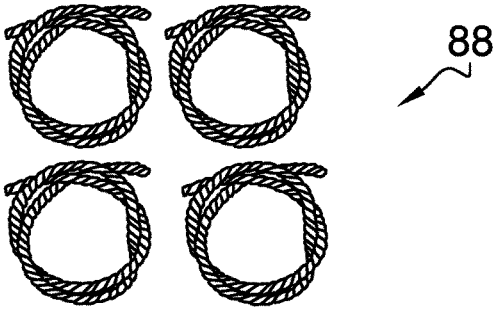
FIG. 4 is a detail view of an embodiment of the disclosure.

The assembly 10 comprises a plurality of ropes 88, as shown in FIG. 4. The plurality of ropes 88 comprises four ropes 88. Each rope 88 is configured to be positioned on a surface so that the rope 88 extends linearly from proximate to the post 24, as shown in FIG. 6. An outer limit 90 of the rope 88 defines a spot from which the user is to toss the ring 74. In a variation of the game, more than one rope 88 may be extended in sequence to increase the distance between the user and the post 24.

In use, the post 24 is assembled from the plurality of tubes 26 and attached to the base 12. The crossbars 48 are assembled by attaching the segments 52 to the couplers 30. If desired, caps 64 are coupled to the fasteners 62 to increase the difficulty of the game. Each of up to four players or four teams of players select of set of loops 76 and position themselves at the outer limit 90 of a respective rope 88 for tossing the rings 74 onto the crossbars 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ring-tossing game assembly comprising:

a base, said base comprising a first connector, said first connector being T-shaped, said first connector being tubular-type, a pair of first rods selectively insertable into said first connector such that said first rods are opposingly positioned and frictionally coupled to said first connector, and a pair of second rods, each said second rod being coupled to and extending bidirectionally from a respective said first rod such that said base is I-shaped;

a post coupled to and extending perpendicularly from said base, said post comprising a plurality of tubes, each said tube having a lower end such that said lower end of a respective said tube is positioned for inserting into said first connector for coupling said post to said base such that said respective said tube is selectively rotatable relative to said base, and a plurality of couplers, said couplers being tubular-type, each said coupler being cross-shaped, each said coupler being coupled to an upper end of a respective said tube wherein said plurality of tubes is positioned for interconnecting by inserting said lower end of a respective said tube into a respective said coupler positioned on an adjacently positioned said tube for frictionally coupling said respective said tube to said respective said coupler with said respective said tube being opposingly positioned and selectively rotatable relative to said adjacently positioned said tube;

a plurality of crossbars, each said crossbar having respective opposing ends, each said crossbar being coupled to and extending bidirectionally from said post, each said crossbar being U-shaped such that said opposing ends of said crossbar extend toward a top of said post, each said crossbar comprising a pair of segments, said segments being tubular such that a terminus of each said segment is positioned for inserting into a respective said coupler such that said segments are opposingly positioned and frictionally coupled to said respective said coupler;

a plurality of rings wherein each said ring is configured for grasping in a hand of a user positioned proximate to said post positioning the user for tossing said ring toward said post intending said ring for insertably coupling to a respective said crossbar;

a plurality of fasteners, said fasteners being tubular-type, said fasteners being coupled singly to each said opposing end of said plurality of crossbars; and a plurality of caps, each said cap comprising a shaft, said shaft being selectively insertable to a respective said fastener for frictionally coupling said cap to a respective said crossbar.

2. The assembly of claim 1, further comprising:

each said second rod comprising a pair of sections, and a pair of second connectors, said second connectors being T-shaped, said second connectors being tubular-type, each said second connector being coupled to a respective said first rod distal from said first connector wherein each said second connector is positioned for selectively inserting a respective said pair of sections such that said sections are opposingly positioned and frictionally coupled to said second connector.

3. The assembly of claim 1, further including said plurality of tubes comprising seven said tubes.

4. The assembly of claim 1, further including a plurality of finials, each said finial comprising a bar, said bar being selectively insertable into said top of said post for coupling said finial to said post.

5. The assembly of claim 4, further including each said finial having a respective shape such that said plurality of finials comprises finials having a variety of shapes.

6. The assembly of claim 5, further including said plurality of finials comprising a football shaped finial, a baseball shaped finial, a soccer ball shaped finial, and a goal-post shaped finial.

7. The assembly of claim 1, further including said plurality of crossbars being evenly spaced between said base and said top of said post, said plurality of crossbars comprising five said crossbars.

8. The assembly of claim 1, further including each said segment having a proximate section, a medial section, and a distal section, said proximate section extending perpendicularly from said post, said medial section extending from said proximate section distal from said post, said distal section extending from said medial section distal from said proximate section such that said distal section extends perpendicularly to said proximate section and parallelly to said post toward said top of said post.

9. The assembly of claim 1, further including each said cap having a respective shape such that said plurality of caps comprises caps having a variety of shapes.

10. The assembly of claim 9, further including said plurality of caps comprising a set of football shaped caps, a set of baseball shaped caps, and a set of soccer ball shaped caps.

11. The assembly of claim 1, further including said plurality of rings comprising four sets of loops, each said set of loops having a respective color.

12. The assembly of claim 1, further including a crossbeam coupled to and extending bidirectionally from said post proximate to said top wherein said plurality of rings is positioned for insertably coupling to said crossbeam for storing said plurality of rings.

13. The assembly of claim 12, further including said crossbeam comprising a pair of pieces, said pieces being tubular such that a first endpoint of each said piece is positioned for inserting into a respective said coupler such that said pieces are opposingly positioned and frictionally coupled to said respective said coupler, each said piece being bent proximate to a midpoint of said piece such that a second endpoint of said piece extends toward said top of said post.

14. The assembly of claim 1, further including a plurality of ropes, each said rope being configured for positioning on a surface such that said rope extends linearly from proximate to said post wherein an outer limit of said rope defines a spot from which the user is to toss said ring.

15. The assembly of claim 1, further including said plurality of ropes comprising four said ropes.

16. A ring-tossing game assembly comprising:

a base, said base comprising:

a first connector, said first connector being T-shaped, said first connector being tubular-type, a pair of first rods selectively insertable into said first connector such that said first rods are opposingly positioned and frictionally coupled to said first connector, a pair of second rods, each said second rod being coupled to and extending bidirectionally from a respective said first rod such that said base is I-shaped, each said second rod comprising a pair of sections, and a pair of second connectors, said second connectors being T-shaped, said second connectors being tubular-type, each said second connector being coupled to a respective said first rod distal from said first connector wherein each said second connector is positioned for selectively inserting a respective said pair of sections such that said sections are opposingly positioned and frictionally coupled to said second connector;

a post coupled to and extending perpendicularly from said base, said post comprising:

a plurality of tubes, each said tube having a lower end such that said lower end of a respective said tube is positioned for inserting into said first connector for coupling said post to said base such that said respective said tube is selectively rotatable relative to said base, said plurality of tubes comprising seven said tubes, and a plurality of couplers, said couplers being tubular-type, each said coupler being cross-shaped, each said coupler being coupled to an upper end of a respective said tube wherein said plurality of tubes is positioned for interconnecting by inserting said lower end of a respective said tube into a respective said coupler positioned on an adjacently positioned said tube for frictionally coupling said respective said tube to said respective said coupler with said respective said tube being opposingly positioned and selectively rotatable relative to said adjacently positioned said tube;

a plurality of finials, each said finial comprising a bar, said bar being selectively insertable into a top of said post for coupling said finial to said post, each said finial having a respective shape such that said plurality of finials comprises finials having a variety of shapes, said plurality of finials comprising a football shaped finial, a baseball shaped finial, a soccer ball shaped finial, and a goal-post shaped finial;

a plurality of crossbars, each said crossbar having respective opposing ends, each said crossbar being coupled to and extending bidirectionally from said post, each said crossbar being U-shaped such that said opposing ends of said crossbar extend toward said top of said post, said plurality of crossbars being evenly spaced between said base and said top of said post, said plurality of crossbars comprising five said crossbars, each said crossbar comprising:

a pair of segments, said segments being tubular such that a terminus of each said segment is positioned for inserting into a respective said coupler such that said segments are opposingly positioned and frictionally coupled to said respective said coupler, each said segment having a proximate section, a medial section, and a distal section, said proximate section extending perpendicularly from said post, said medial section extending from said proximate section distal from said post, said distal section extending from said medial section distal from said proximate section such that said distal section extends perpendicularly to said proximate section and parallelly to said post toward said top of said post, a plurality of fasteners, said fasteners being tubular-type, said fasteners being coupled singly to each said opposing end of said plurality of crossbars, and a plurality of caps, each said cap comprising a shaft, said shaft being selectively insertable to a respective said fastener for frictionally coupling said cap to a respective said crossbar, each said cap having a respective shape such that said plurality of caps comprises caps having a variety of shapes, said plurality of caps comprising a set of football shaped caps, a set of baseball shaped caps, and a set of soccer ball shaped caps;

a plurality of rings wherein each said ring is configured for grasping in a hand of a user positioned proximate to said post positioning the user for tossing said ring toward said post intending said ring for insertably coupling to a respective said crossbar, said plurality of rings comprising four sets of loops, each said set of loops having a respective color;

a crossbeam coupled to and extending bidirectionally from said post proximate to said top wherein said plurality of rings is positioned for insertably coupling to said crossbeam for storing said plurality of rings, said crossbeam comprising a pair of pieces, said pieces being tubular such that a first endpoint of each said piece is positioned for inserting into a respective said coupler such that said pieces are opposingly positioned and frictionally coupled to said respective said coupler, each said piece being bent proximate to a midpoint of said piece such that a second endpoint of said piece extends toward said top of said post; and a plurality of ropes, each said rope being configured for positioning on a surface such that said rope extends linearly from proximate to said post wherein an outer limit of said rope defines a spot from which the user is to toss said ring, said plurality of ropes comprising four said ropes.

* * * * *